US005554039A

United States Patent [19]

Doudon

[11] Patent Number: 5,554,039

[45] Date of Patent: Sep. 10, 1996

[54] QUICK PLUG CONNECTOR FOR ELECTRIC DISTRIBUTION SYSTEM(S)

[75] Inventor: Robert Doudon, St. Nicephore, Canada

[73] Assignee: Siemens Electric Limited, Brampton, Canada

[21] Appl. No.: 536,291

[22] Filed: Sep. 29, 1995

[51] Int. Cl.[6] ..... H01R 25/00

[52] U.S. Cl. ..... 439/115; 439/13

[58] Field of Search ..... 439/115, 13, 20, 439/21, 22, 27, 18

[56] References Cited

U.S. PATENT DOCUMENTS

| | | | |
|---|---|---|---|
| 2,437,579 | 3/1949 | Wilson | 173/334.1 |
| 2,924,802 | 2/1960 | Platz et al. | 339/21 |
| 2,924,804 | 2/1960 | Frank et al. | 339/21 |
| 2,946,037 | 7/1960 | Platz et al. | 339/154 |
| 3,081,442 | 3/1963 | Platz | 339/14 |
| 3,299,391 | 1/1967 | Herrmann et al. | 339/14 |
| 3,871,730 | 3/1975 | Hesse | 439/115 |
| 4,053,194 | 10/1977 | Gilman | 439/115 |

*Primary Examiner*—Gary F. Paumen
*Assistant Examiner*—T. C. Patel
*Attorney, Agent, or Firm*—Ira Lee Zebrak, Esq.

[57] ABSTRACT

An electrical connector adapted to be operatively connected to a wall outlet and to continuous outlet cables. The connector includes an insulated housing, neutral, ground and line contact means for making contact with the neutral, ground and line wires of the outlet cable, and a rotatable plug to be operatively connected to the wall outlet and for making contact to the neutral, ground, and line contact means.

7 Claims, 8 Drawing Sheets

QUICK PLUG CONNECTOR FOR ELECTRIC DISTRIBUTION SYSTEM(S)

FIELD OF THE INVENTION

The present invention relates generally to electric distribution systems and more particularly to a removable electrical connector to an electric wall outlet and an electric distribution system.

BACKGROUND OF THE INVENTION continuous outlet electric distribution systems provide a source of electric power readily usable at any point along its length. U.S. Pat. No. 2,924,804 entitled Electric Distribution System, illustrates a two wire continuous outlet duct or cable construction in which there is a flat plastic body strip having inwardly turned lips along the longitudinal edges thereof with longitudinally extending conductors imbedded beneath the lips. The lips are closely spaced from the body of the strip so as to provide a pair of continuous longitudinally extending openings through which power may be tapped from the conductors at any point along the length of the strip. The strip is also provided with an integrally formed longitudinally extending projection or polarizing rib disposed in an off center position between the lips. A third or grounding conductor wire can be provided which is conveniently imbedded in the main body of the strip and positioned adjacent to the polarizing rib with the surface of the grounding conductor being exposed. Such a construction is illustrated in abandoned U.S. patent application Ser. No. 754,079, filed Aug. 8, 1958, in the name of J. B. Cataldo et al., entitled Three Wire Electric Distribution System and assigned to the assignee of the instant invention.

Electrical connection between the source of electric power and the electrical distribution system is accomplished by various types and designs of feed-in boxes which are frequently complex and require tools and specific instructions for their installation and use.

Outlet receptacles which are connected to the continuous outlet electric distribution system are ideally easily, correctly and economically connected thereto at any point along its length without requiring tools or particular installation procedures or techniques.

A need exists for a quick and simple electrical connector between an electric wall outlet and the electric distribution system without the need for special feed-in boxes or the need to add an electric line from a circuit panel/distribution board to the electric distribution system.

OBJECT OF THE INVENTION

It is a general object of the invention to provide a quick, simple and detachable connector for making the electrical connection between a source of electric power and an electric distribution system from an electric wall outlet.

SUMMARY OF THE INVENTION

In accordance with one aspect of the invention, a removable electrical connector is provided which is adapted to be operatively connected to a wall outlet having blade guides and a ground prong receiving aperture and further adapted to be operatively connected to a plurality of continuous outlet cables having a neutral wire, a ground wire and a line wire. The connector includes an insulated housing comprising a case and a cover; a neutral contact means and a ground contact means and a line contact means for making contact with the neutral wires, ground wires and line wires of the plurality of continuous outlet cables; a rotatable plug to be operatively connected to the wall outlet and for making contact to the ground contact means, the line contact means, and the neutral contact means. The rotatable plug includes a neutral blade contact having at a first end a blade portion for connection to the wall outlet and at a second end a neutral contact edge for making contact with the neutral contact means; a line blade contact having at a first end a blade portion for connection to the wall outlet and at a second end a line contact edge for making contact with the line contact means; a ground star contact having a flat cruciform and a ground prong extending from an underside of the cruciform for connection to the wall outlet, the flat cruciform having a plurality of extensions each one of the extensions having a ground contact edge for making contact with the ground contact means. The rotatable plug being adapted to align the neutral blade portion and the line blade portion and the ground prong, and being rotatable to orient the neutral blade portion and line blade portion and the ground prong to mate with the blade guides and ground prong receiving apertures of the wall outlet. The neutral contact means comprises a neutral contact flat ring for being contacted by the neutral contact edge of the rotatable plug and further having a plurality of arms extending outwardly from the flat ring, each of the arms having a neutral camming portion connected to a neutral cable engaging portion engageable with the neutral wire of a corresponding one of the continuous outlet cables, each of the neutral camming portions being biased in a retracted position wherein the electrical connector is mountable to and demountable from a corresponding one of the continuous outlet cables. The line contact means comprises a line contact flat ring for being contacted by the line contact edge of the rotatable plug and further having a plurality of arms extending outwardly from the flat ring, each of the arms having a line camming portion connected to a line cable engaging portion engageable with the line wire of a corresponding one of the continuous outlet cables, each of the line camming portions being biased in a retracted position wherein the electrical connector is mountable to and demountable from a corresponding one of the continuous outlet cables. The ground contact means comprises a plurality of ground contacts, each of the ground contacts having a rib which connects at one end to a shoulder for receiving contact with any one of the edges of the ground star contact, the rib connecting at a second end to a ground cable engaging portion engageable with the ground wire of a corresponding one of the continuous outlet cables, each of the ribs being biased in a retracted position wherein the electrical connector is mountable to and demountable from a corresponding one of the continuous outlet cables. The cover of the housing has a plurality of cover pushers each being moveable between a first and a second position relative to the case, a corresponding one of the neutral camming portions and a corresponding one of the line camming portions and a corresponding one of the ribs being in a retracted position when a corresponding one of the cover pushers is in the first position, each of the cover pushers having pushing means which when the corresponding cover pusher is moved from the first to the second position pushes said corresponding one of the line camming portions and the corresponding one of the neutral camming portions and the corresponding one of the ribs to extended positions wherein the corresponding one of the line cable engaging portion and the corresponding one of the neutral cable engaging portion and the corresponding one of the ground cable engaging portion are engageable with the line wire and the neutral wire and the ground wire of the corresponding one of the continuous outlet cables.

DETAILED DESCRIPTION

Figure 1:
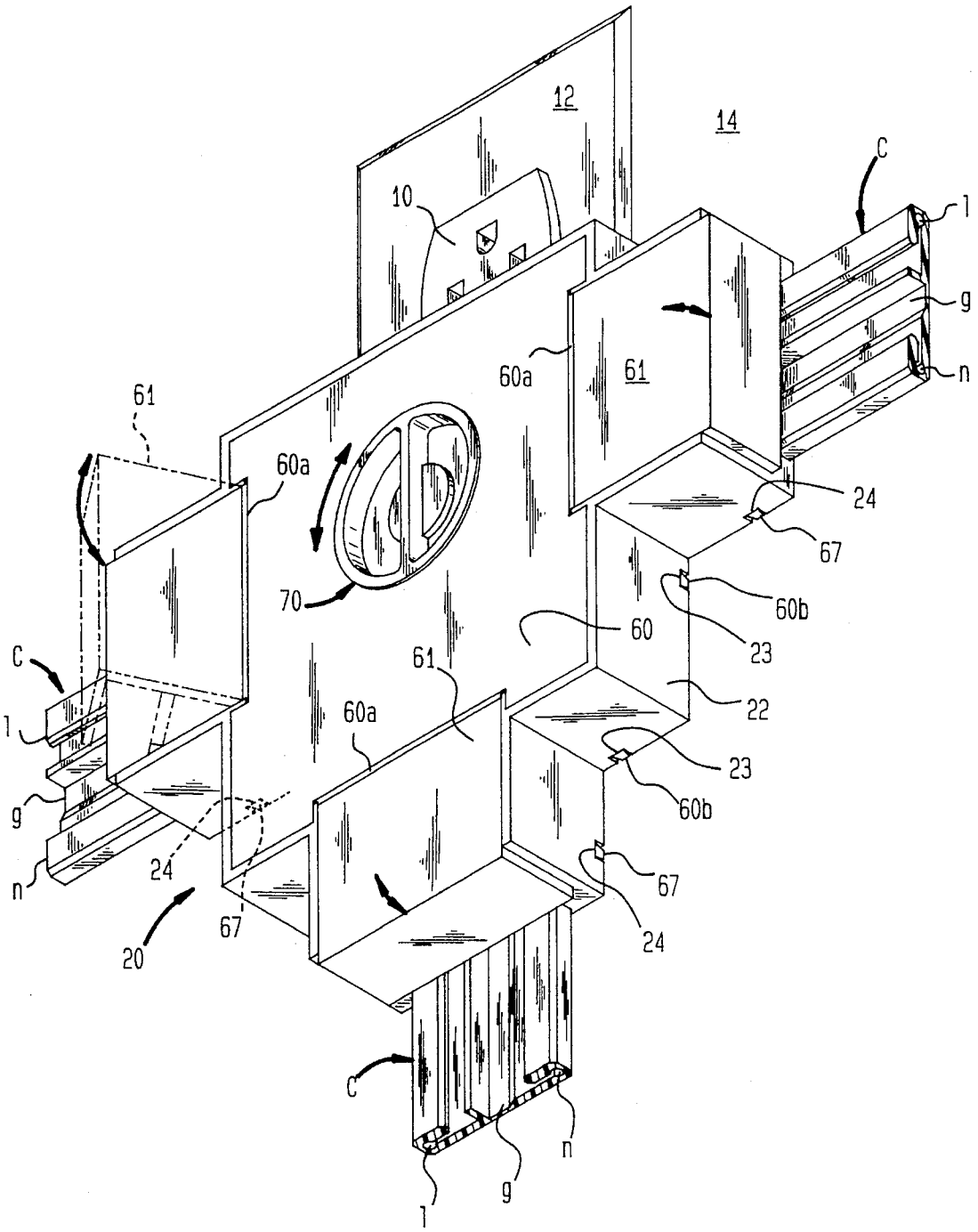
FIG. 1 is a perspective illustrating a quick plug connector in accordance with the present invention mounted to an electrical wall outlet and connected to three continuous outlet electrical distribution systems.

Referring to Fig. 1, the quick plug connector 20 of the present invention is shown connected to a wall outlet 10 covered by front plate 12 both of which are secured to wall 14. Quick plug connector 20 is shown connected to three continuous outlet cables C each of which has a line wire 1, a ground wire g, and a neutral wire n extending along their lengths.

Quick plug connector 20 is comprised of a molded insulated housing comprising a hollow case 22 and a cover 60 mounted to case 22 by latch hooks 60b which extend from the underside of cover 60 and snap fit into latch openings 23 formed in case 22. Instead of forming the latch hooks as integral parts of cover 60, they can be separate components. When cover 60 is mounted onto case 22, latch hooks 60*b* pass through latch openings 23 and snap onto the edge of openings thereby securing cover 60 to case 22. To open quick plug connector 20, latch hooks 60*b* are pressed laterally inward to clear the edge of the latch openings.

Figure 2:
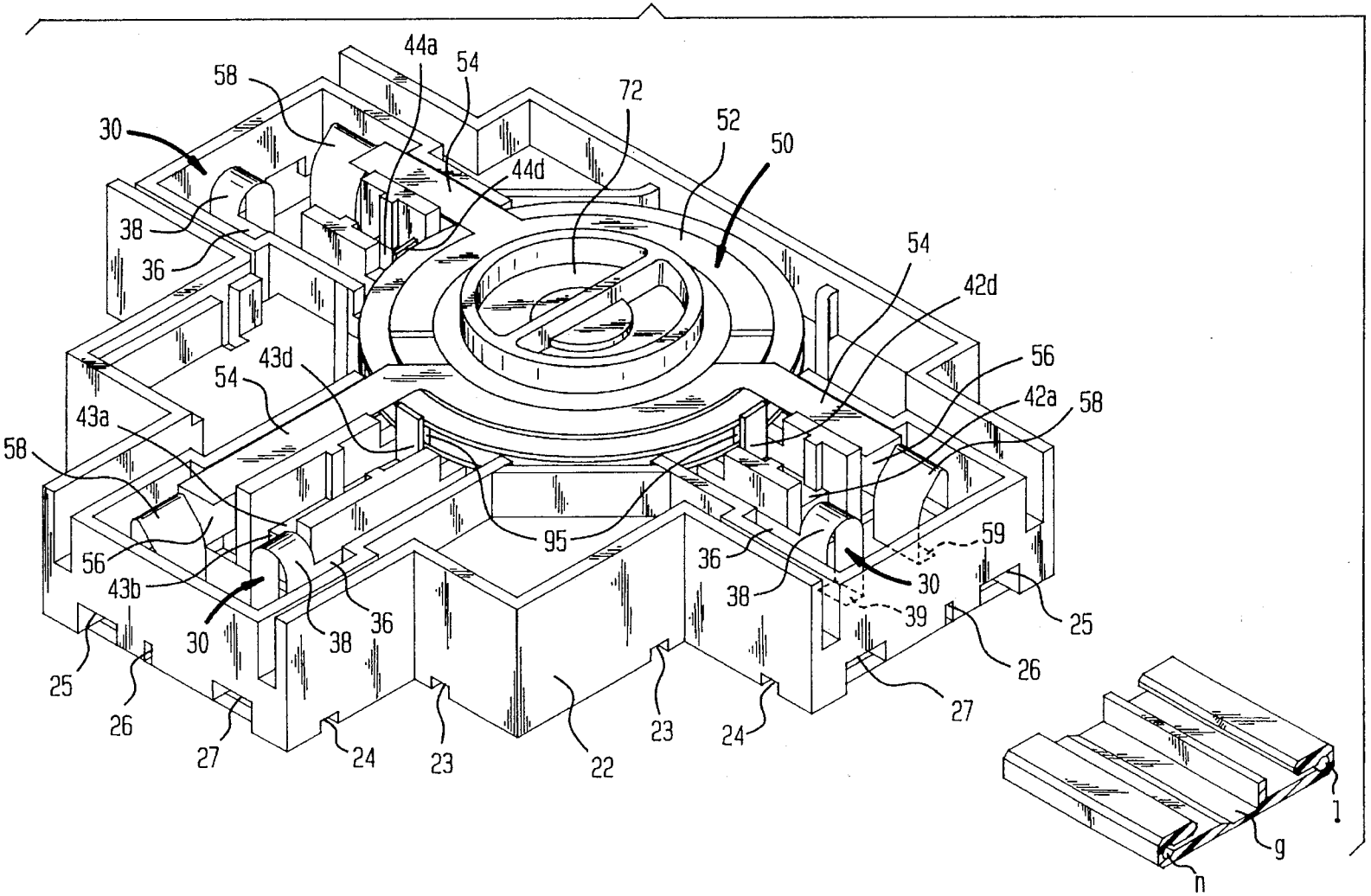
FIG. 2 is a perspective of the quick plug connector illustrated in FIG. 1 with the cover removed.

Referring to FIG. 2, case 22 has openings 25, 26, 27 in its walls to match the shape of the cross-sectional area of the continuous outlet cable for aligning and positioning the imbedded line, ground and neutral conductors of continuous outlet cable C. Mounted within case 22 in correspondingly shaped recesses are a neutral contact means 30, a ground contact means 40, and a line contact means 50 (FIGS. 2 and 9) for making electrical contact, as more fully described below, with each of the neutral wires n, ground wires g, and line wires 1, respectively, of each of the three continuous outlet cables C. Neutral contact means 30, ground contact means 40 and line contact means 50 are constructed of sheet spring material having good electrical conductivity.

Figure 9:
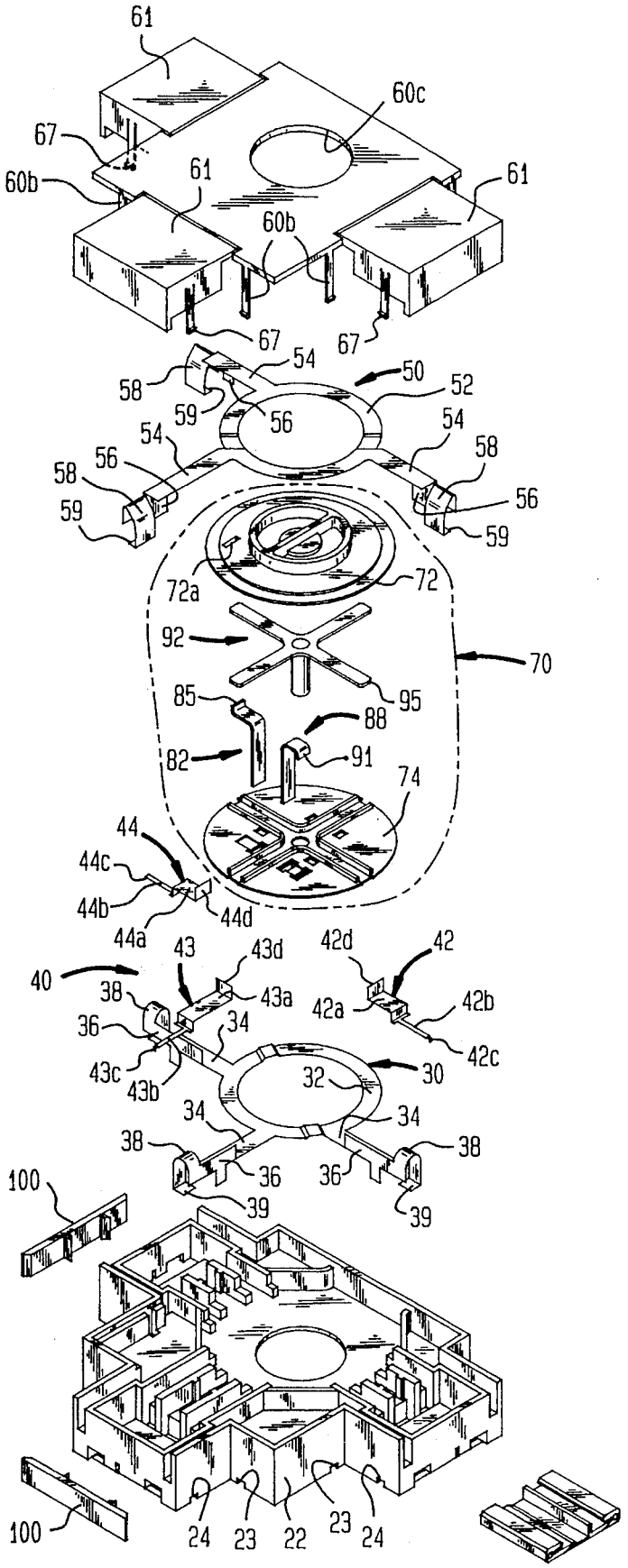
FIG. 9 is an exploded view of the quick connector plug shown in FIGS. 1 and 2.

Referring to FIG. 2 and more particularly FIG. 9, neutral contact means 30 is shown as a singular element having a flat ring 32 and three arms 34 extending outwardly from the outer edge of ring 32. Each arm 34 has a flange 36 extending orthogonally therefrom and which terminates with a curved shape camming position 38. At the lower end of camming portion 38 is a neutral cable engaging portion 39, the free end of which is serrated in order to facilitate making good electrical contact with neutral wire n of continuous outlet cable C.

Line contact means 50 is also a single element having a flat ring 52 and three arms 54 extending outwardly from the outer edge of ring 52. Each arm 54 has a flange 56 extending orthogonally therefrom and which terminates with a curved shaped camming portion 58. At the lower end of camming portion 58 is a line cable engaging portion 59, the free end of which is serrated in order to facilitate making good electrical contact with line wire 1 of continuous outlet cable C.

Referring to FIG. 9, ground contact means 40 includes three separate ground contacts 42, 43 and 44. Each of the three ground contacts 42, 43, and 44 has a mounting part 42*a*, (43*a*, 44*a*) and a series of bends which conform to the recesses in case 22 for mounting. Extending from one end of each mounting part is a rib 42*b* (43*b*, 44*b*) which terminates in a ground cable engaging portion 42*c* (43*c*, 44*c*). On the opposite end of mounting part 42*a* (43*a*, 44*a*) is a shoulder 42*d* (43*d*, 44*d*) which makes electrical contact with ground contact edges 95 of rotatable plug 70 as more fully described below. Since ground contacts 42, 43, and 44 as well as neutral contact means 30 and line contact means 50 are each a one-piece construction, the reliability and safety of quick plug connector 20 is increased due to the reduction in the possibility of failure, misalignment or malfunction in making and maintaining electrical contact with the line wire 1, ground wire g, and neutral wire n of each of the three continuous outlet cables C.

Figure 4A:
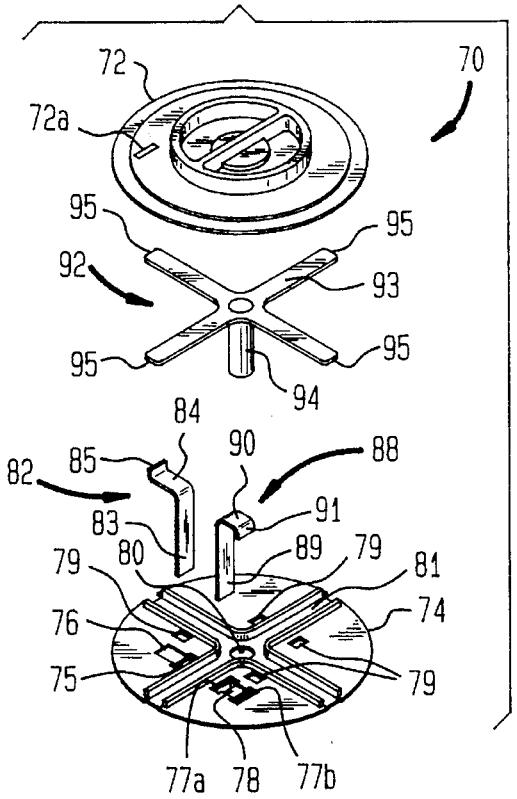
FIG. 4A is an exploded view of the rotatable plug shown in FIGS. 1 and 2.
Figure 4B:
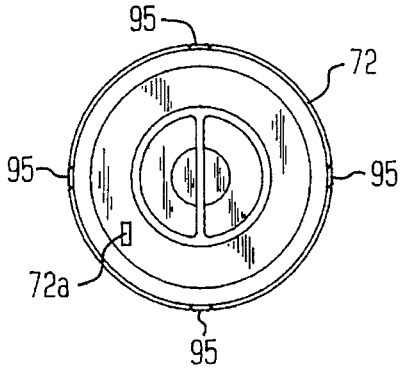
FIG. 4B is a top view of the assembled rotatable plug shown in FIG. 4A.
Figure 4C:
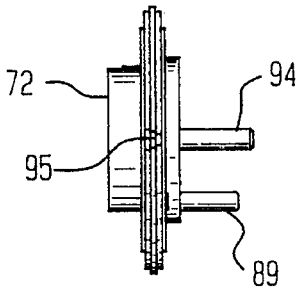
FIG. 4C is a side view of the assembled rotatable plug shown in FIG. 4A.
Figure 5:
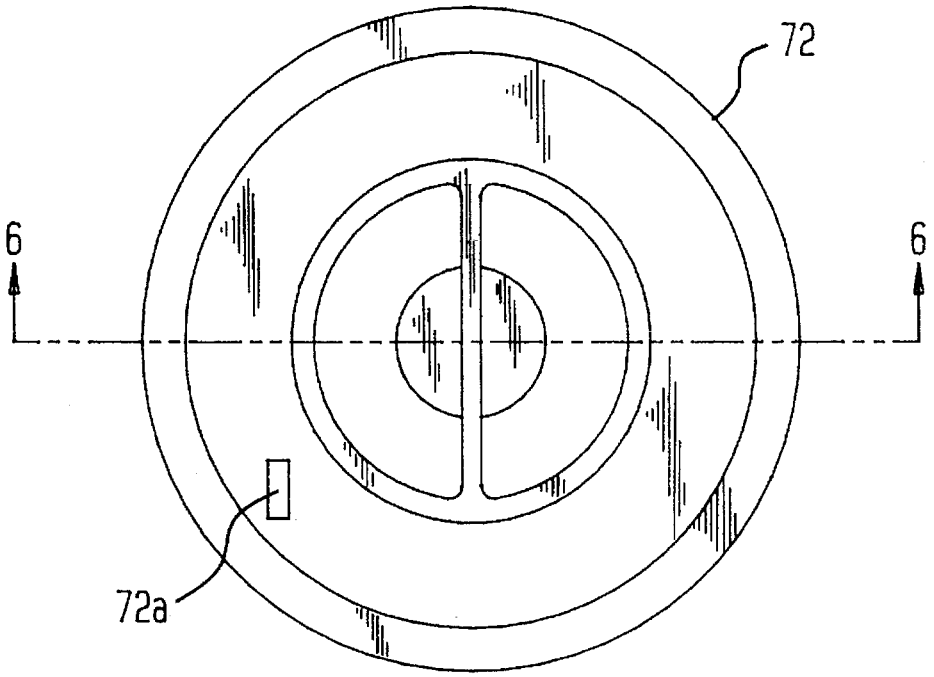
FIG. 5 is a top view of the top element of the rotatable plug shown in FIG. 4A.
Figure 6:
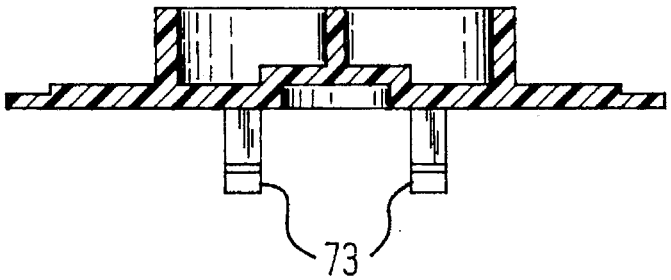
FIG. 6 is a sectional view of the top element of the rotatable plug taken along line 6—6 of FIG. 5.
Figure 7:
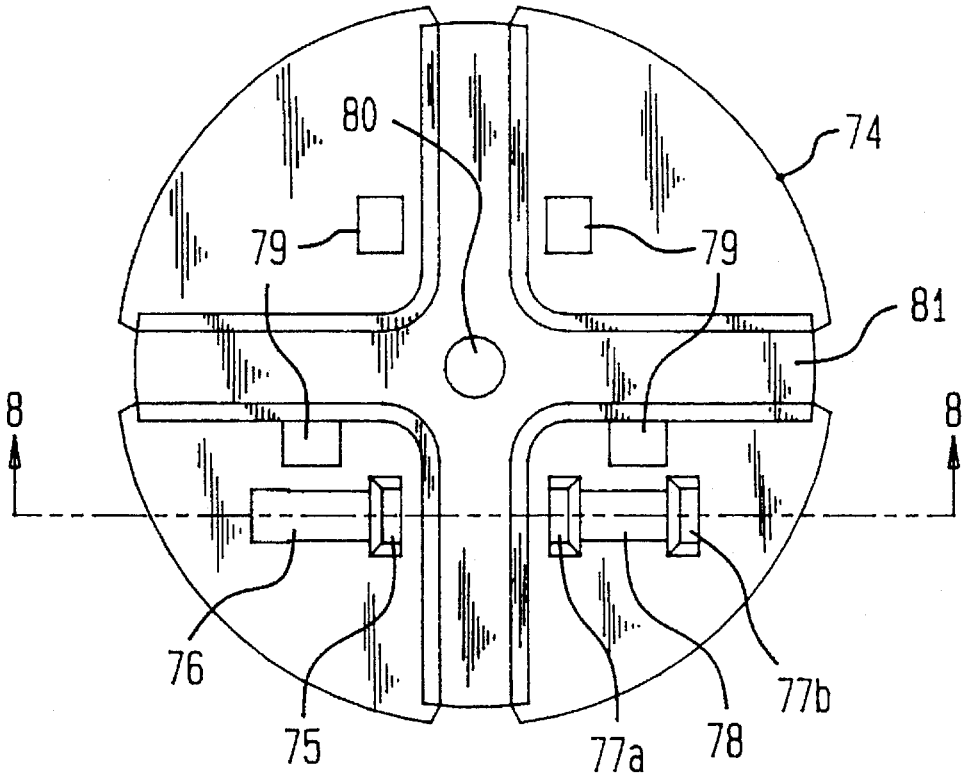
FIG. 7 is a top view of the bottom element of the rotatable plug shown in FIG. 4A.
Figure 8:
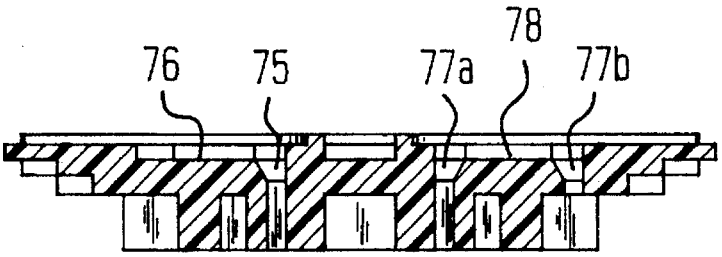
FIG. 8 is a sectional view of the bottom element shown in FIG. 7 of the rotatable plug taken along line 8—8.

Establishing electrical contact between wall outlet 10 and the ground contact means 40, line contact means 50, and neutral contact means 30 of quick plug connector 20 is accomplished by rotatable plug 70. Referring to FIG. 4A, rotatable plug 70 is comprised of a top 72 and a bottom 74 for mounting a ground star contact 92, a line blade contact 82, and a neutral blade contact 88. Extending from the underside of top 72 are hooks 73 which snap fit into apertures 79 in bottom 74 (FIGS. 5–7) to mount line blade contact 82, neutral blade contact 88 and ground star contact 92 therebetween to form rotatable plug 70 as shown in FIG. 4C.

In order to be able to connect to a wall outlet in which the receptacle is mounted either horizontally or vertically or is mounted so that the aperture in the wall outlet for the ground prong is positioned either upward or downward, the rotatable plug 70 can be rotated to re-orient the position of the line blade contact 82, neutral blade contact 88 and ground prong 94 to match that of the receptacle and maintain proper polarity while keeping the continuous outlet cables in the same position and orientation.

Referring to FIG. 4A, line blade contact 82 has at one end a blade portion 83 for connection to the line contact of the wall outlet. The other end of the line blade contact 82 passes through aperture 75 in bottom element 74, where bent portion 84 is seated in recess 76, and terminates at a contact edge 85. Contact edge 85 of line blade contact 82 passes through slot 72*a* in top 72 to make electrical contact with flat ring 52 of line contact means 50 (FIG. 2).

Neutral blade contact 88 which is "J" shaped has a blade portion 89 for connection to the neutral contact of the wall outlet. The other end of neutral blade contact 88 passes through aperture 77*a* in bottom element 74 where a bent portion 90 is seated in recess 78 of bottom element 74 and terminates at a contact edge 91 which passes through aperture 77*b* to the underside of bottom element 74 (FIG. 4A). Contact edge 91 of neutral blade contact 88 makes electrical contact with neutral contact flat ring 32 of neutral contact means 30 (FIG. 9).

Ground star contact 92 is in the shape of a flat cruciform 93 with a ground prong 94 which extends orthogonally from the underside of cruciform 93 as shown in FIG. 4A. On the outer edge of each of the four extensions of the cruciform 93 are contact edges 95. Flat cruciform 93 is positioned within cruciformed shaped tray 81 formed in the inner face of bottom 74 and ground prong 94 extends through opening 80 in bottom element 74 for connection to the ground contact of the wall outlet. Contact edges 95 of ground star contact 92 are positioned in rotatable plug 70 to make electrical contact with shoulders 42*d*, 43*d*, 44*d* of ground contacts 42, 43, 44 respectively.

The neutral circuit path from wall outlet 10 through quick plug connector 20 to the continuous outlet cable C is through neutral blade 89 whose contact edge 91 is in electrical contact with flat ring 32, the neutral cable engaging portion 39 of which makes electrical contact with the neutral wire n of continuous outlet cable C.

The line circuit path from wall outlet 10 through quick plug connector 20 to the continuous outlet cable C is through line blade 83 whose contact edge 85 is in electrical contact with flat ring 52, the line cable engaging portion 59 of which makes electrical contact with the line wire 1 of continuous cable C.

The ground circuit path from wall outlet 10 through quick plug connector 20 to continuous outlet cable C is through ground prong 94 through cruciform 93 whose contact edges 95 are in electrical contact with shoulders 42*d*, 43*d*, and 44*d* of grounds contacts 42, 43 and 44 the ground cable engaging portions 42*c* , 43*c* and 44*c* of which make electrical contact with the ground wire g of continuous outlet cable C.

Figure 3A:
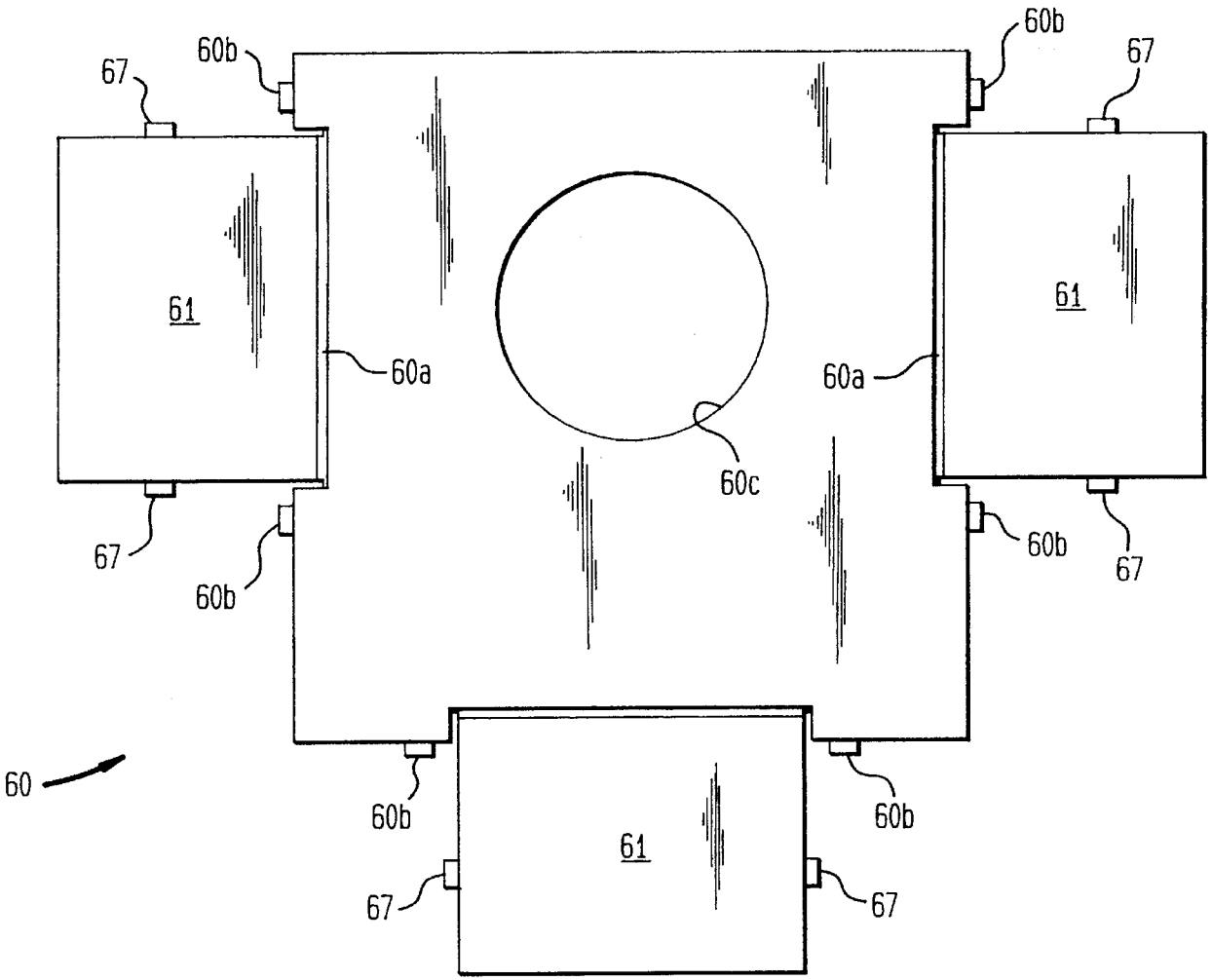
FIG. 3A is a plan view of the cover of the quick plug connector shown in FIG. 1.

In order to establish electrical contact between quick plug connector 20 and the continuous outlet cable(s) C, cover 60 is adapted to have three rotatable cover pushers 61 which when placed in a closed position cause the neutral, line and ground contact means to engage the neutral wire, line wire and ground wire of the three continuous outlet cables. A molded hinge 60*a* connects each rotatable cover pusher 61 to cover 60 and thereby enables the cover pusher to be rotated from an open position to the closed position. (FIGS. 1 and 3A) In a preferred embodiment, cover 60, cover pusher 61, hinge 60*a*, latching hooks 60*b*, and cover pusher hooks 67 are integral parts of a one-piece molding.

Figure 3B:
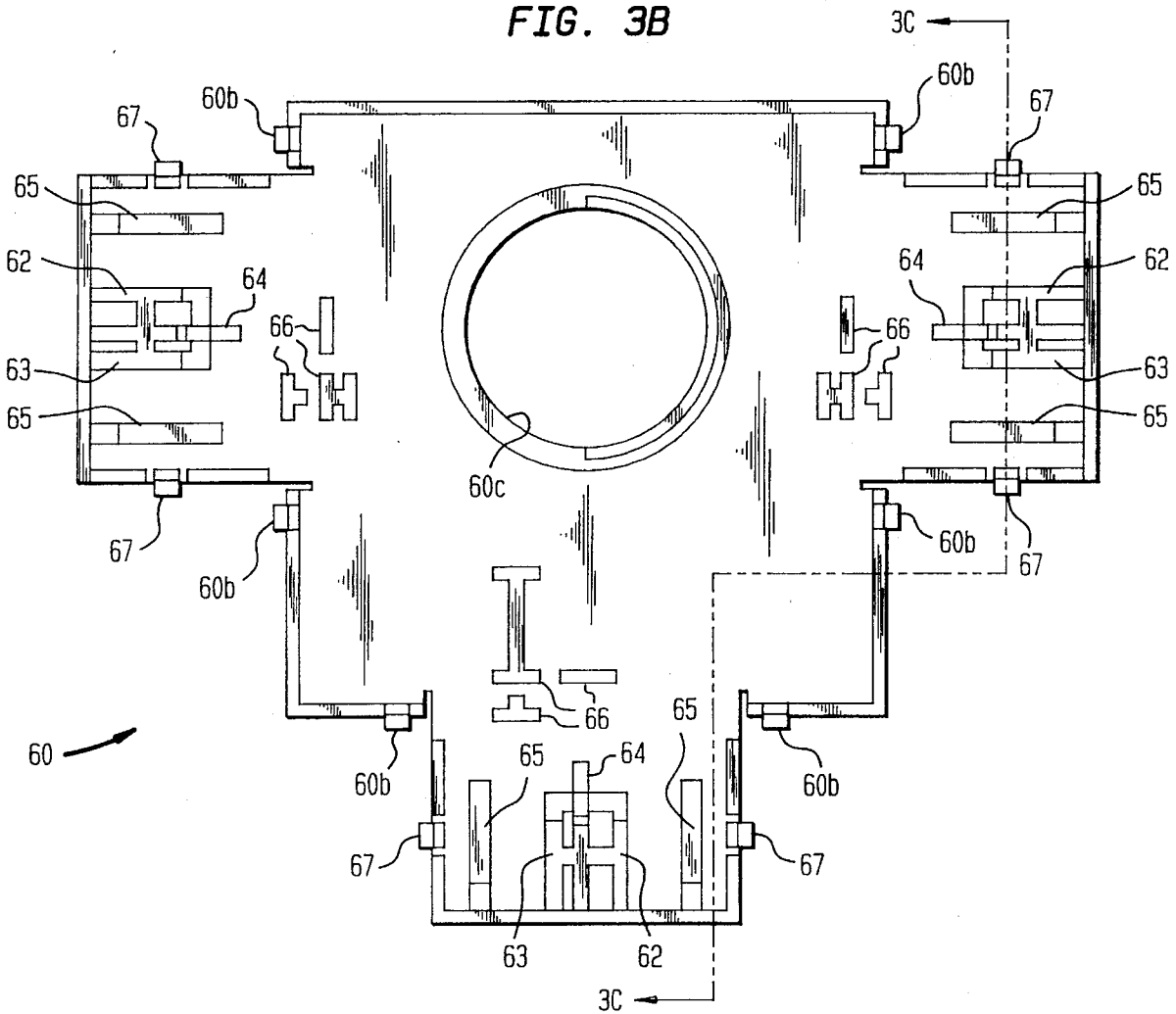
FIG. 3B is a plan view of the underside of the cover shown in FIG. 3A.
Figure 3C:
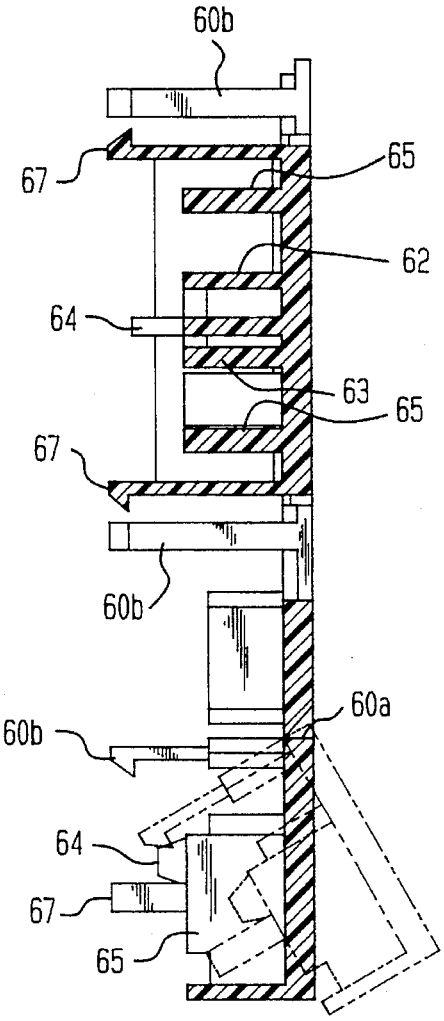
FIG. 3C is a sectional view of the cover taken along line C—3C in FIG. 3B.

Referring to FIG. 3B which is a plan view of the underside of cover 60, each cover pusher 61 is provided with neutral contact pusher 63, line contact pusher 62, and ground contact pusher 64 which project from its underside for causing the neutral, line and ground contact means to engage the neutral wire, line wire and ground wire, respectively, of the continuous outlet cable(s).

Neutral contact pusher 63, line contact pusher 62, and ground contact pusher 64 are positioned on the underside of each cover pusher 61 so that when cover 60 is mounted to case 22 and cover pusher 61 is rotated into a closed position with respect to case 22, they are caused to engage respectively, neutral camming portions 38 of neutral contact means 30, line camming portions 58 of line contact means 50, and rib 42*b* (43*b* or 44*b*) of ground contact means 40, causing neutral cable engaging portions 39, line cable engaging portion 59 and ground cable engaging portion 42*c* (43*c* or 44*c*), respectively, to move into engagement and make electrical contact with neutral wire n, line wire 1, ground wire g of the continuous outlet cable C. The movement of the free edges of neutral cable engaging portion 39 and line cable engaging portion 59 which are serrated, scrape through any foreign matter or dirt accumulations to assure good electrical contact with continuous outlet cable C.

To secure continuous outlet cable C to quick plug connector 20, cover pusher 61 is moved to the open position shown by phantom lines at the left in FIG. 1. The longitudinal edges and longitudinal extending polarizing rib of the continuous outlet cable C is placed within contoured openings 25, 26 and 27 (FIG. 2) of case 22. Openings 25, 26 and 27 are shaped to correspond to that of the outer contour of continuous outlet cable C to maintain proper polarity of and to preclude incorrect positioning of continuous outlet cable C with respect to quick plug connector 20. Strip guides 65 which extend from the underside of each cover pusher 61, assist in correctly positioning continuous outlet cable C. Cover pusher 61 is then rotated around molded hinge 60*a* to its closed position causing neutral contact means 30, line contact means 40, and ground contact means 50 to respectively engage, as described above, the neutral wire n, line wire 1, and ground wire g of the continuous outlet cable C. When cover pusher 61 is in the closed position, cover pusher hooks 67 which extend from the underside of cover pusher 61 engage corresponding recesses 24 in case 22 to lock cover pusher to the case and secure continuous outlet cable C to quick plug connector 20.

When cover pusher 61 is rotated to the open position, neutral contact pusher 63, line contact pusher 62, and ground contact pusher 64 disengage respectively from contact with neutral camming portion 38, line camming portion 58 and ground rib 42*b* (43*b*,44*b*) which are made of a spring material and which thereby enable neutral cable engaging portion 39, line cable engaging portion 59, and ground cable engaging portion 42*c* (43*c*, 44*c*)to retract to a disengaged position and thereby permit dismounting of continuous outlet cable C from quick plug connector 20.

To install quick plug connector 20, cover pusher 61 is opened by releasing cover pusher hooks 67 from apertures 24 in case 20 and then rotated to the open position. Rotatable plug 70 is turned to the position in which the orientation of ground prong 94, neutral blade 89 and line blade 83 matches the orientation of the ground prong opening and the blade guides of wall outlet 10. As a safety precaution, electric power to the wall outlet should be turned off before connecting quick plug connector 20 to wall outlet 10. Ground prong 94, neutral blade 89 and line blade 83 are inserted into wall outlet 10. Continuous outlet cable C is then inserted into openings 25, 26, 27 in case 22 and cover pusher 61 is rotated into its closed position causing electrical contact to be made with continuous outlet cable C. Continuous outlet cable C can then be secured to the wall in any conventional manner. Other continuous outlet cables are similarly connected to the quick plug connector in the same manner as described above. If each of the three provisions for continuous outlet cables C are not utilized, openings 25, 26, 27 may be closed with the installation of end caps 100 (FIG. 9).

The quick plug connector of the present invention is a detachable receptacle which is less expensive and more reliable in operation in part because it utilizes a one-piece line contact means and a one-piece neutral contact means. The use of latches to secure the cover pushers to the case and latches to secure the cover to the case as well as the use of line cable engaging portion 59 and neutral cable engaging portion 39 which engage and secure the continuous outlet cable(s), ensures positive closing and reduces the possibility of inadvertent disengagement of the continuous outlet cable. Since the quick plug connector is secured to the continuous outlet cable which is typically secured to the wall, the quick plug connector cannot be inadvertently removed from the wall.

The quick plug connector has several features which render it easy to install:

(a) it can be plugged into any standard grounded wall outlet;

(b) rotatable plug can be rotated to orient the ground prong and line and neutral blades to match that of the wall receptacle and maintain proper polarity while also maintaining the continuous outlet cables in the same position and orientation without having to alter or re-orient the wall outlet;

(c) mechanical and electrical contact to the continuous outlet cable is made by simply rotatable the cover pusher onto the continuous outlet cable;

(d) the continuous outlet cable can't be incorrectly connected to the quick plug connector because of the use of alignment holes in the side of the case which are contoured to that of the continuous outlet cable.

While the foregoing description and drawings represent the preferred embodiments of the present invention, it will be apparent to those skilled in the art that various changes and modifications may be made therein without departing from the true spirit and scope of the present invention.

I claim:

1. A removable electrical connector adapted to be operatively connected to a wall outlet having blade guides and a ground prong receiving aperture and further adapted to be operatively connected to a plurality of continuous outlet cables having a neutral wire, a ground wire and a line wire, said connector including:

(a) an insulated housing comprising a case and a cover;

(b) a neutral contact means and a ground contact means and a line contact means for making contact with the neutral wires, ground wires and line wires of the plurality of continuous outlet cables respectively;

(c) a rotatable plug to be operatively connected to the wall outlet and for making contact to the ground contact means, the line contact means, and the neutral contact means;

the rotatable plug comprising:

a neutral blade contact having at a first end thereof a blade portion for connection to the wall outlet and at a second end a neutral contact edge for making contact with the neutral contact means;

a line blade contact having at a first end thereof a blade portion for connection to the wall outlet and at a second end a line contact edge for making contact with the line contact means;

a ground star contact having a flat cruciform and a ground prong extending from an underside of the cruciform for connection to the wall outlet, the flat cruciform having a plurality of extensions each one of said extensions having a ground contact edge for making contact with the ground contact means;

the rotatable plug being adapted to align the neutral blade portion and the line blade portion and the ground prong, the rotatable plug being rotatable to orient the neutral blade portion and line blade portion and the ground prong to mate with the blade guides and ground prong receiving apertures of the wall outlet;

the neutral contact means comprising a neutral contact flat ring for being contacted by the neutral contact edge of the rotatable plug and further having a plurality of arms extending outwardly from said flat ring, each of said arms having a neutral camming portion connected to a neutral cable engaging portion engageable with the neutral wire of a corresponding one of the continuous outlet cables, each of said neutral camming portions being biased in a retracted position wherein the electrical connector is mountable to and demountable from a corresponding one of the continuous outlet cables;

the line contact means comprising a line contact flat ring for being contacted by the line contact edge of the rotatable plug and further having a plurality of arms extending outwardly from said flat ring, each of said arms having a line camming portion connected to a line cable engaging portion engageable with the line wire of a corresponding one of the continuous outlet cables, each of said line camming portions being biased in a retracted position wherein the electrical connector is mountable to and demountable from a corresponding one of the continuous outlet cables;

the ground contact means comprising a plurality of ground contacts, each of said ground contacts having a rib which connects at one end to a shoulder for receiving contact with any one of the edges of the ground star contact, the rib connecting at a second end to a ground cable engaging portion engageable with the ground wire of a corresponding one of the continuous outlet cables, each of said ribs being biased in a retracted position wherein the electrical connector is mountable to and demountable from a corresponding one of the continuous outlet cables;

the cover of said housing having a plurality of cover pushers each being moveable between a first and a second position relative to said case, a corresponding one of the neutral camming portions and a corresponding one of the line camming portions and a corresponding one of the ribs being in a retracted position when a corresponding one of said cover pushers is in said first position, each of the cover pushers having pushing means which when said corresponding cover pusher is moved from said first to said second position pushes said corresponding one of the line camming portions and said corresponding one of the neutral camming portions and said corresponding one of the ribs to extended positions wherein said corresponding one of the line cable engaging portion and said corresponding one of the neutral cable engaging portion and said corresponding one of the ground cable engaging portion are engageable with the line wire and the neutral wire and the ground wire of the corresponding one of the continuous outlet cables.

2. The removable electrical connector as in claim 1 wherein the line contact means is a one-piece construction.

3. The removable electrical connector as in claim 1 wherein the neutral contact means is a one-piece construction.

4. The removable electrical connector as in claim 3 wherein the line contact means is a one-piece construction.

5. The removable electrical connector as in claim 4 wherein the pushing means projects from an underside of at least one cover pusher.

6. The removable electrical connector as in claim 5 further comprising a latch hook which extends from an underside of the cover and a latch opening formed in the case wherein the latch hook snap fits into the latch opening when the cover is secured to the case.

7. The removable electrical connector as in claim 6 wherein the rotatable plug further includes a top and a bottom for mounting the neutral blade contact and the line blade contact and the ground star contact.

* * * * *